US005197526A

United States Patent [19]

Schön

[11] Patent Number: 5,197,526

[45] Date of Patent: Mar. 30, 1993

[54] DEVICE FOR THE INTERNAL SHADING OF GLASS AREAS WITH A HANGING MEANS

[75] Inventor: Siegfried J. Schön, Meer, Belgium

[73] Assignee: Schon B.V., Breda, Netherlands

[21] Appl. No.: 632,389

[22] Filed: Dec. 26, 1990

[30] Foreign Application Priority Data

Dec. 27, 1989 [EP] European Pat. Off. ..... 89123962

[51] Int. Cl.[5] ..... E06B 9/06

[52] U.S. Cl. ..... 160/84.1; 160/115

[58] Field of Search ..... 160/84.1, 172, 277, 160/134, 115, 179

[56] References Cited

U.S. PATENT DOCUMENTS 2,179,572 11/1939 Bowman ..... 160/172
4,934,436 6/1990 Schnebly ..... 160/84.1
5,042,550 8/1991 Yee ..... 160/84.1

FOREIGN PATENT DOCUMENTS 240065 10/1987 European Pat. Off. .
2252251 5/1974 Fed. Rep. of Germany .
3214503 10/1983 Fed. Rep. of Germany .
3441574 3/1984 Fed. Rep. of Germany .
8908566 10/1989 Fed. Rep. of Germany .

*Primary Examiner*—Blair M. Johnson
*Attorney, Agent, or Firm*—Jacobson, Price, Holman & Stern

[57] ABSTRACT

In order in a device for internal shading of triangular, trapezoidal, polygonal or semicircular glass areas with a foldable or gatherable hanging means or drape, the hanging edge of which displaceable for the closure and opening is equipped with a profile strip and the side edges of which adjoining the displaceable hanging means edge are guided on holding means, to make available a completely novel constructional concept which is able to cover with simple construction a great number of complicated and possibly irregular area forms both for vertical and for inclined or possibly horizontal glass areas, the profile strip is divided into two or more strip portions (6, 7) which are articulately connected to each other.

20 Claims, 6 Drawing Sheets

DEVICE FOR THE INTERNAL SHADING OF GLASS AREAS WITH A HANGING MEANS

Figure 1:
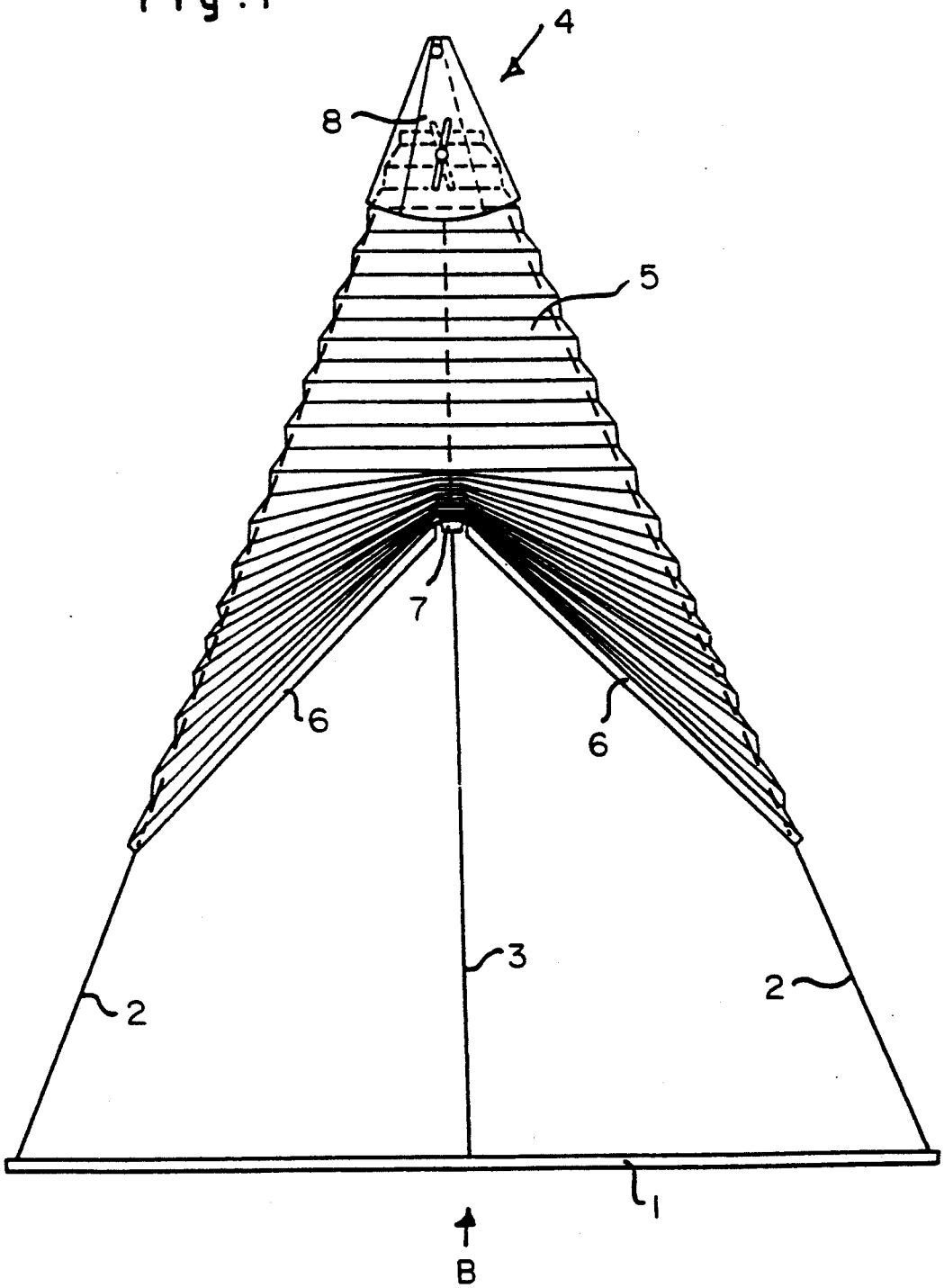

The present invention relates to a device for the internal shading of triangular, trapezoidal, polygonal or semicircular-like glass areas with a foldable or gatherable hanging means, the hanging edge of which displaceable for the closing and opening is equipped with a profile strip and the side edges of which adjoining the displaceable hanging edge are guided in holding means.

Such devices usually have the form of the glass areas to be shaded. They may be equipped with a frame having the form of the glass area to be shaded. They may also be made frameless or only partially equipped with frame sections. However, in every case the drape or hanging means as a rule has the form of the glass area to be shaded.

The terms "triangular", "trapezoidal" and "polygonal" are to be interpreted not only as the forms which come under these definitions in exact manner geometrically. The terms are also intended to include shapes in which one or more side edges are made curved or arcuate. The term "semicircular-like" is intended to include areas having the form of a semicircle, a circular segment or an elliptical segment or the like.

Devices of this type have been known in a great variety of constructions for a long time.

Thus, for example, for triangular glass areas devices are used (cf. EU-A1 0240065) which have a horizontal lower rail and an upper rail extending at an acute angle thereto. The lower and upper rails are articulately connected to each other at one end. Between the two rails a drape or hanging means in the form of a pleated fabric is arranged, the pleats of which run into the connection region of the two rails in the manner of a fan. The upper rail is secured stationary to the window frame. The lower rail may be pivoted upwardly by means of a pull cord arrangement and brought into a parallel position beneath the lower rail. The pleated fabric is thereby folded together and in the open position of the device lies as drape package between the two rails.

For trapezoidal glass areas devices are again used (cf. for example DE-OS 3,441,574) which are made up in a similar manner. They also have a stationary upper rail and a movable lower rail between which a hanging means or drape in the form of a pleated fabric is disposed. In this known construction as well, for opening the hanging means the lower rail is pivoted upwardly by means of a pull-cord arrangement and brought into a position parallel to the upper rail. The drape then lies in the opened condition as a pack between the upper and lower rail.

With devices of this type certain triangular or trapezoidal glass areas of simple geometrical form can be shaded. However, as soon as glass areas of more complicated geometrical form are involved the principle on which these known solutions is based is no longer applicable. If openable and closeable solutions exist at all for such complicated geometrical forms then they are concretely adapted to the particular area form and based on completely different construction concepts.

The problem underlying the present invention is to make available a completely novel construction concept which is suitable not only for specific simple and regular triangular or trapezoidal glass areas but is also able to cover a great number of more complicated and possibly irregular area forms. The structure of the devices is to remain simple and to be suitable not only for vertical but also for inclined and possibly horizontal glass areas.

This problem is solved according to the invention in a device of the type described at the beginning in that the profile strip connected to the displaceable hanging means edge is divided into two or more strip portions which are articulately connected to each other.

The invention is based on the knowledge that the known straight one-piece profile strips considerably restrict the range of use so that a solution is not possible for relatively complicated area forms. Thus, the division of the profile strip according to the invention into strip portions connected articulately to each other permits a great number of possible uses and consequently a considerably greater spectrum of areas can be covered. The invention is further based on the surprising recognition that even conventional foldable or gatherable drape materials can be readily bent or even buckled in the region of the articulate connection when correspondingly configured without thereby having to accept a visible impairment. Thus, it has been determined by tests that on corresponding formation of the buckling or bending point a life of 15 to 20 years can readily be achieved.

The idea according to the invention of dividing the profile strip into articulately interconnected strip portions and the surprising recognition that with appropriate configuration of the hanging means in the joint regions of the strip portions bending and buckling may be carried out without any impairment leads to a great number of possible uses, also enabling complicated and irregular area forms to be covered.

It is particularly advantageous to implement the basic idea according to the invention in that the strip portions in the closed state of the hanging means each lie in the wider region of the glass area and for opening the hanging means are displaced into the constricted region of the glass area. In other words, according to the invention the arrangement is advantageously always to be such that the profile or section strip consisting of a plurality of strip portions in the closed state of the hanging means lies in the wide region of the glass area in the extended or at least substantially extended state and in the opening operation is pushed into the constricted region of the glass area. Due to the articulate connection and the corresponding dimensioning of the strip portions, in the opening operation the latter adapt themselves to the narrowing area form and then, in the completely open state of the device, corresponding to the particular area form, come to lie in a greater or lesser bent state with the associated hanging means pack in the edge region of the narrowed glass area.

For glass areas in the form of a triangle having a base side and a corner opposite said side it is necessary according to the invention for said corner to lie on a perpendicular to the base side. Said perpendicular must then either run through one of the end points of the base side or intersect the base side at some point between the end points. With such an area form, to enable the strip portions to be displaced from the wide region of the glass area into the narrowed region it is necessary according to the invention for the strip portions in the closed state of the hanging means to run parallel to the base side and the articulate connection of the strip portions to lie in each case in the region of the perpendicular through the corner.

Corresponding conditions apply to glass areas in the form of a trapezium or a polygon which has a respective base side and two or more corners opposite thereto. The corners must lie on a respective perpendicular to the base side running between the end points of the base side or through the end points. With such area forms it is also advantageous to make the strip portions in the closed state of the hanging means run parallel to the base edge and place each articulate connection of the strip portions so that they are each arranged in the region of the perpendicular through the corners. In this manner the possibility outlined above is achieved of exactly adapting the strip portions in the opened state to the particular area shape.

In the case of glass areas in the form of a semicircle, a circular segment or an elliptical segment or the like as well, with straight or bent base side, it is advantageous for the strip portions in the closed state of the hanging means to run parallel to the base side and in the opened state to lie in the region of the rounded portion of the glass area in the form of a polygon and in this manner leave free an optimum passage cross-section.

The strip portions can be configured in a great variety of manners. It is however particularly advantageous for the strip portions each to be formed by C or U profiles.

For most areas of use the strip portions may have predetermined length. For specific uses however it may be expedient to make the strip portions telescopically extendable.

For particular uses it may further be expedient to make the strip portions from a flexible material to obtain a still better adaptation to the form of the respective glass area in the opened state.

The holding means for the side edges of the hanging means or drape may be formed in a great variety of manners. Proven means which are advantageous are holding ropes, cables and tensioning wires. For arcuate or curved regions it may be expedient to provide holding spokes as holding means. It is however also possible if necessary to make the holding means in the form of guide profiles.

The articulate connection for the strip portions may also be made in any desired manner. Thus, the articulate connection may be formed by elastic intermediate pieces, hinges or the like. Flexible tape strips are particularly simple and expedient. The important point is that in the region of the articulate connection there are no sharp edges but radii or rounded portions so that the drape material in continuous use does not suffer any damage.

To ensure a clean guiding in particular with inclined or horizontally aligned glass surfaces it is advantageous for each of the outer strip portions of the profile strip to be equipped in the region of their free ends with guide means engaging the holding means. This makes separate holding means for the strip portions superfluous.

The guide means for the strip portions may be configured in a great variety of manners as sliding or rolling guide. They may possibly be arranged movably with respect to the strip portions within limits to compensate length differences with complicated area forms.

Fundamentally, the actuation of the articulately connected strip portions may be effected in any desired manner. It is particularly expedient to use proven pull-cord arrangements for actuating the strip portions.

If a hanging means provided with folds is used, for example of pleated fabric, it is advantageous according to the invention to make the arrangement such that the pleats in the closed state of the hanging means run parallel to the strip portions.

To avoid sagging of the drape in particular with inclined or horizontally extending glass areas and obtain a mechanically stable construction it is advantageous to make the arrangement such that in the region of each articulate connection of at least two strip portions a tensioning wire or the like is arranged at which the articulate connection is guided. Conveniently, for this purpose at least one of the strip portions is guided on the tensioning wire. The simplest type of such a guide resides in providing in the strip portions guide bores through which the respective tensioning wire passes.

In this connection it is advantageous to form a strip portion as short sliding piece guided on the tensioning wire. The following strip portions are then articulately connected to said short sliding piece. Such an articulate connection is not only advantageous from the technical point of view but provides for the hanging means at the articulation point in the closed state a relatively gentle bending or buckling as well.

Hereinafter, for the further explanation and better understanding several examples of embodiment of a device according to the invention for the internal shading of glass areas will be described in detail and explained with reference to the attached drawings.

Figure 2:
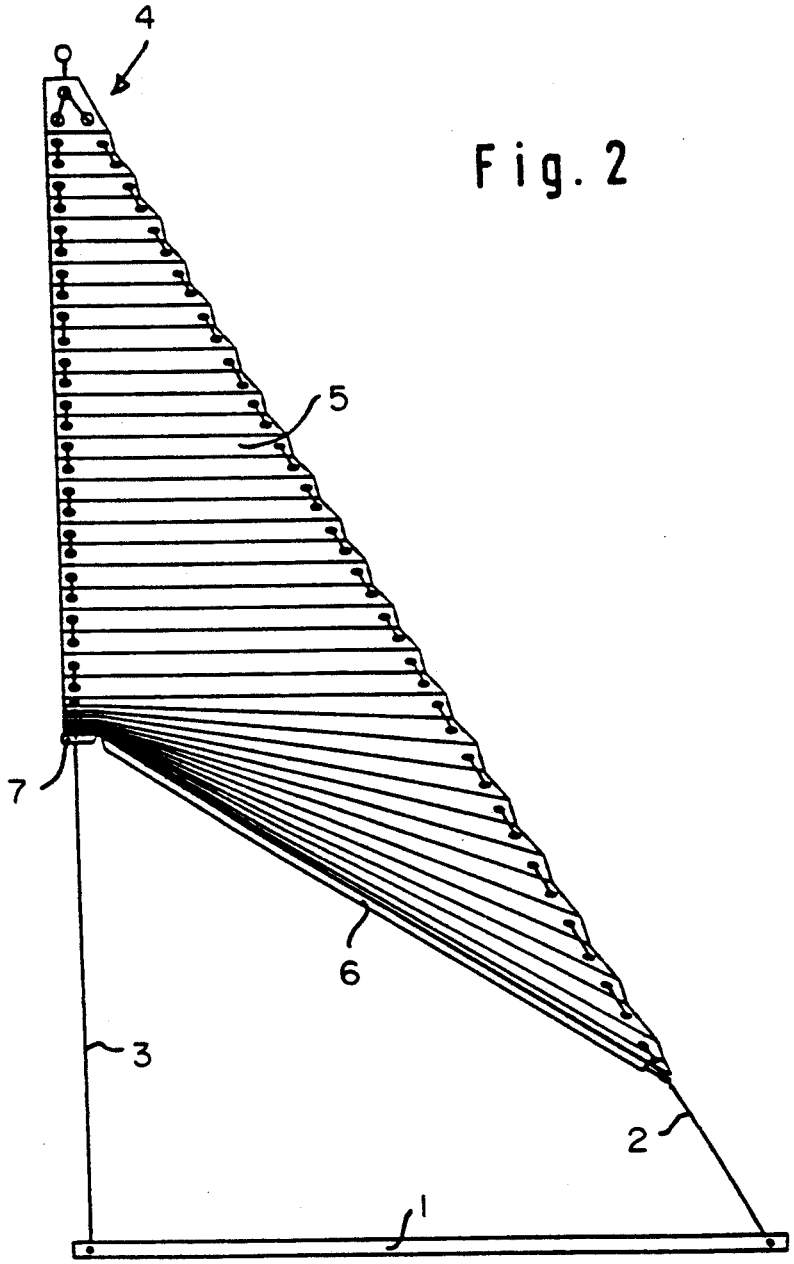
Figure 3:
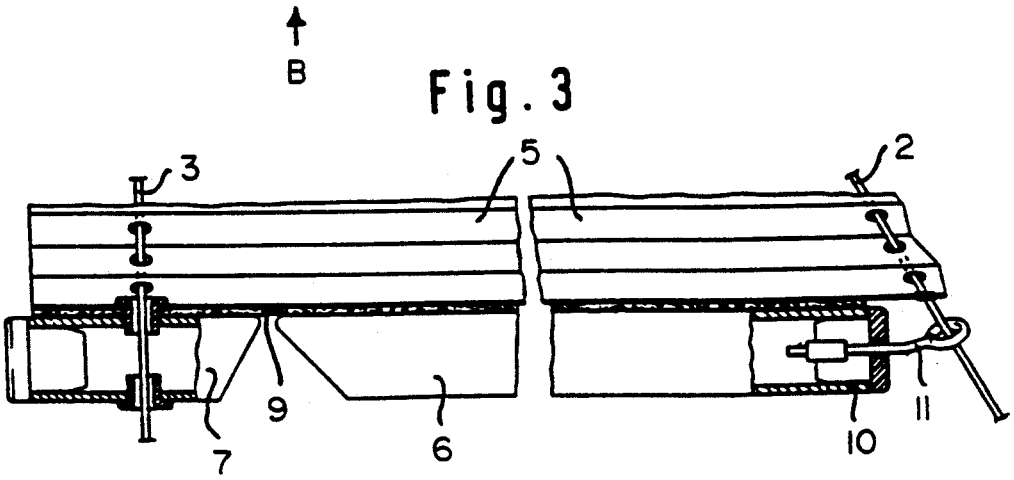
Figure 4:
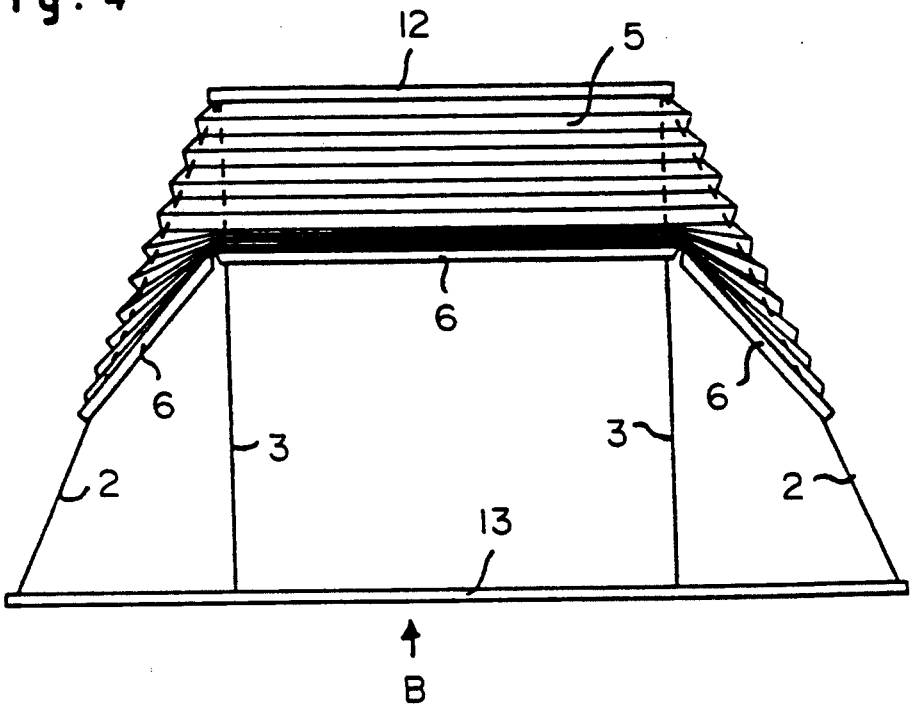
Figure 5:
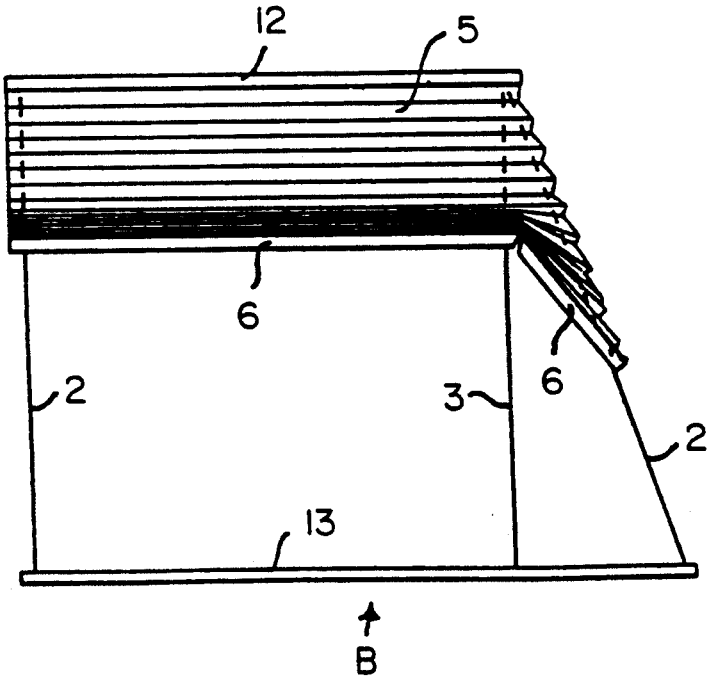
Figure 6:
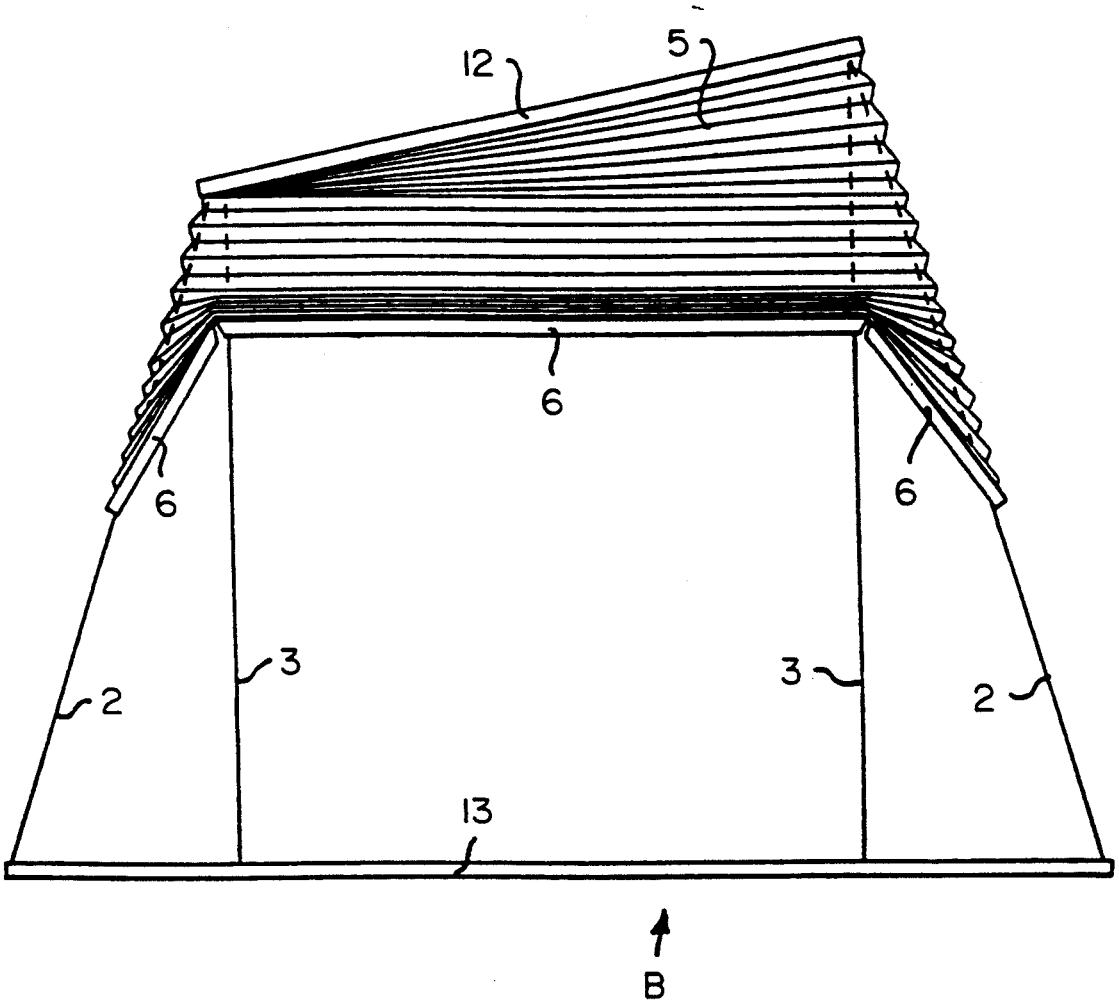
Figure 7:
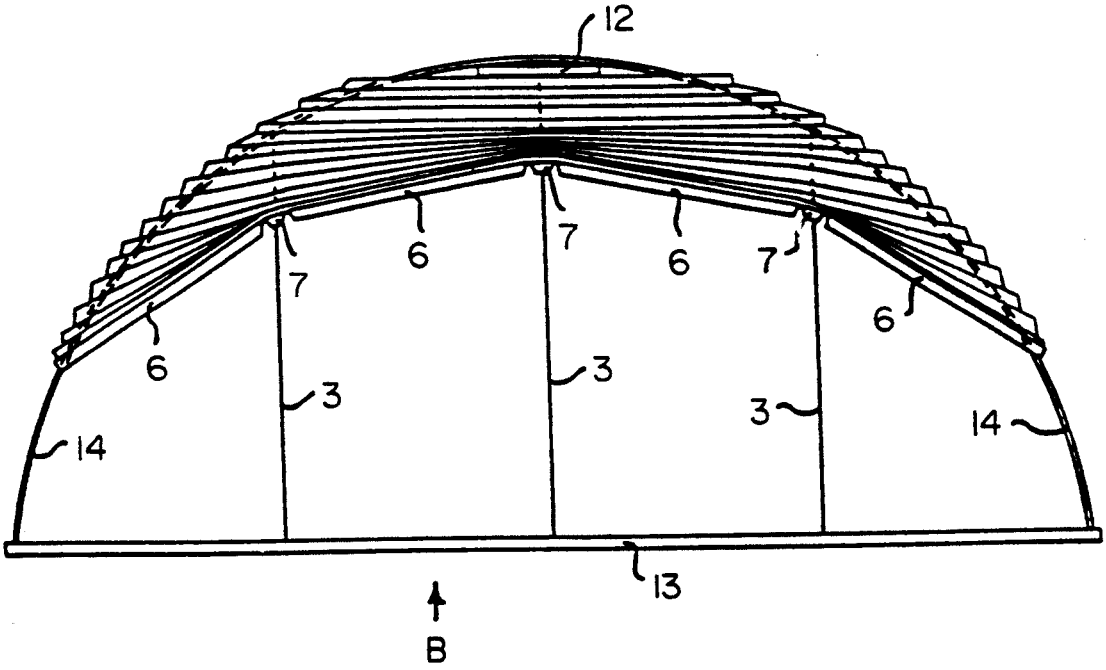
Figure 8:
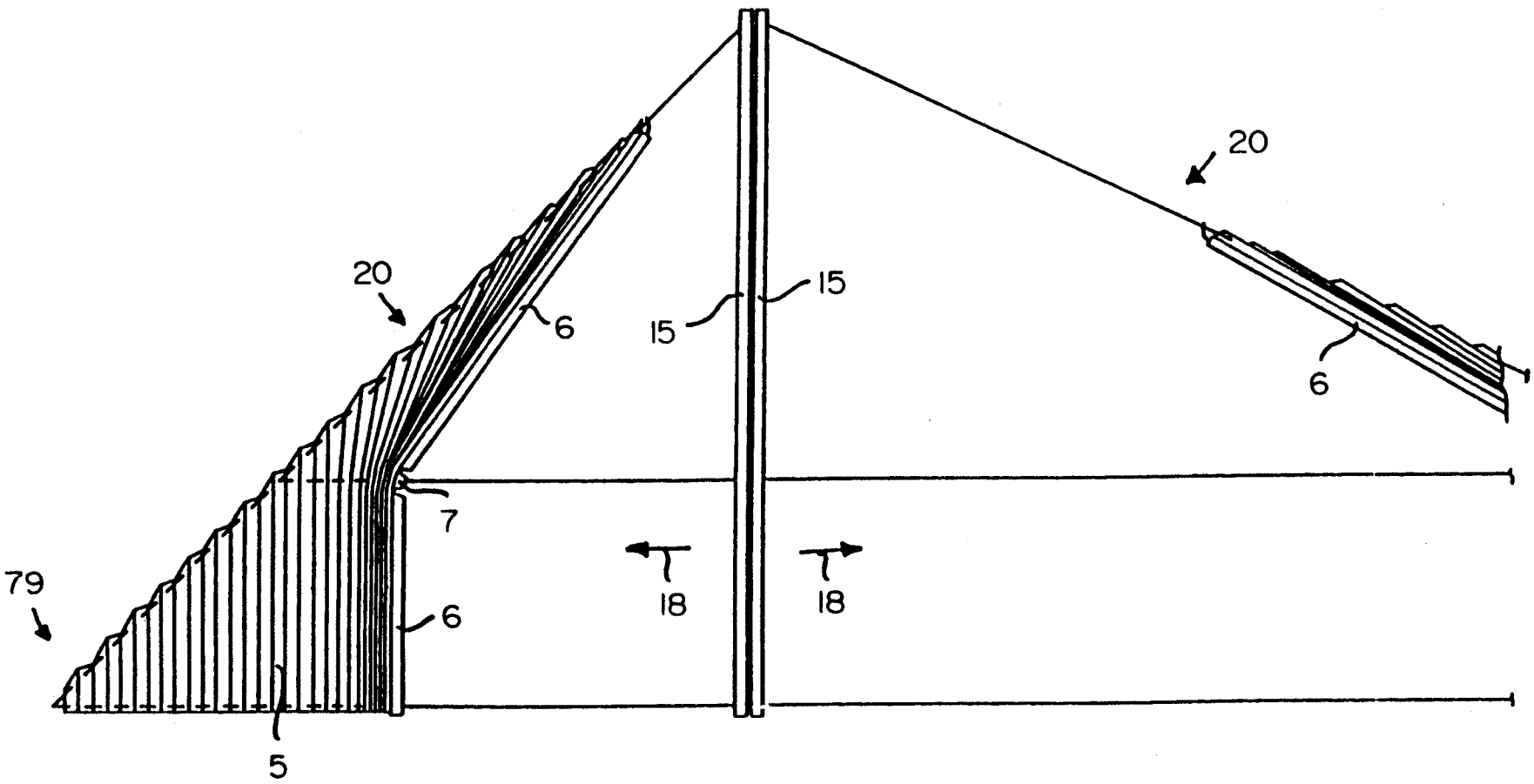

FIG. 1 shows a first example of embodiment of a device according to the invention for the internal shading of a glass surface or area in the form of an equilateral triangle, FIG. 2 shows a second example of embodiment of a device according to the invention for the internal shading of a glass area in the form of a right-angled triangle, FIG. 3 shows a detail of the example of embodiment of FIG. 2 to a larger scale, FIGS. 4, 5 and 6 show various examples of embodiment of a device according to the invention for the internal shading of trapezoidal glass areas of different forms, FIG. 7 shows an example of embodiment of a device according to the invention for the internal shading of a glass area in the form of a circular segment, FIG. 8 shows for use in a gable window two examples of embodiment of a device according to the invention, each of which covers a glass area in the form of a right-angled triangle.

In the example of embodiment illustrated in FIG. 1 the device consists of a stationary horizontal lower rail 1 from which two outer tensioning wires 2 and an inner tensioning wire 3 lead upwardly to an upper corner 4 disposed opposite the lower rail 1. Between the lower rail 1 and the outer tensioning wires 2 a hanging means or drape 5 of pleated material is disposed. In the closed state of the device the hanging means 5 has the form of the equilateral triangle formed by the lower rail 1 and the outer tensioning wires 2, the displaceable hanging means edge extending parallel to the lower rail being equipped with a profile section or strip which consists of three strip portions 6, 7 articulately connected together.

In the present example of embodiment the centre strip portion is formed as short sliding piece 7. For guiding on the inner tensioning wire 3 the sliding piece 7 is equipped with two aligning bores through which the centre tensioning wire 3 is passed. The two outer strip portions 6 are articulately connected via an elastic intermediate piece to the centre strip portion formed as sliding piece 7. Said elastic intermediate piece is formed in the present case by a flexible tape strip as will be explained hereinafter in conjunction with FIGS. 2 and 3.

The free ends of the strip portions 6 are guided displaceably on the outer tensioning wires 2 via guide means.

The side edges of the hanging means 5 adjoining the displaceable hanging means edge are equipped with bores, eyes or the like through which the outer tensioning wires extend. Said outer tensioning wires serve in the present example of embodiment as holding means for the side edges of the hanging means 5.

In its centre the hanging means 5 further has, in superimposed relationship, a plurality of bores, eyes or the like through which the inner tensioning wire 3 extends.

For optical reasons, the upper corner 4 of the device is covered by a triangular cover plate 8.

In the closed state of the device the strip portions 6, 7 rest on the lower rail 1, the lower rail 1 and the strip portions 6, 7 forming the base side of the equilateral triangle.

For opening the device the strip portions 6, 7 bearing on the lower rail are pushed upwardly as is apparent from FIG. 1 which shows a partially opened position of the device. In the completely opened state the strip portions 6 then lie substantially parallel to the outer tensioning wires 2, the sliding piece coming to lie in the corner 4 of the device.

In FIG. 1 the principle underlying the invention is clearly apparent; according to this principle the strip portions 6, 7 in the closed state of the drape or hanging means are disposed in the wide region of the glass area and for opening the hanging means can be pushed into the narrowed region of the glass area, i.e. upwardly into the region of the corner 4.

As apparent from FIG. 1, in the opened state of the device two hanging means packs are formed, the one pack lying over the one and the other over the other strip portion 6. This gives a division of the overall hanging means pack into two parts, resulting in a lesser height of the hanging means packs permitting the greatest possible opening or exposure of the glass area.

The example of embodiment illustrated in FIG. 1 is a "frameless" device. It is of course also possible to arrange rails in the region of the outer tension wires 2 as well, said rails giving together with the lower rail 1 a complete frame in the form of an equilateral triangle.

The device illustrated in FIG. 2 serves for the internal shading of a glass area in the form of a right-angled triangle. As regards the constructional form the device according to FIG. 2 corresponds to one half of the device according to FIG. 1. The strip portion 7 constructed as short sliding piece is guided on the inner tensioning wire 3. A strip portion 6 is again articulately connected to the sliding piece. The detail of the articulation of the sliding piece to the strip portion 6 is shown schematically in FIG. 3. The articulate connection of the sliding piece to the strip portion 6 is also formed in this example of embodiment by an elastic intermediate piece in the form of a flexible tape strip 9 which is stuck on to the upper side of the sliding piece and the following strip portion 6.

As already mentioned in conjunction with the example of embodiment according to FIG. 1, the free ends of the strip portions 6 are each displaceably guided at the outer tensioning wire 2. For this purpose the free ends of the strip portions are equipped with guide means which may be sliding or rolling guides of any desired type. A technically simple and particularly expedient guide means construction is represented schematically in the right half of the detail illustration of FIG. 3. In this embodiment the guide means consists of a ring eye 11 which is guided on the tensioning wire 2. Said ring eye 11 has a shank which is mounted for movement to and fro within limits at the free end 10 of the strip portion 6. This displaceable arrangement gives the necessary change of length when the strip portion 6 is pushed up in the region of the corner 4.

The examples of embodiment of a device according to the invention illustrated in FIGS. 4 to 6 serve for the internal shading of glass areas of various trapezoidal forms. Constructionally, these examples of embodiment are implemented in the same manner as the devices according to FIGS. 1 and 2. On the basis of the trapezoidal form the profile strip is divided into three strip portions (FIGS. 4 and 6), into two strip portions (FIG. 5) and into seven strip portions (FIG. 7). All the examples of embodiment have an upper rail 12 and a lower rail 13. The upper hanging means or drape edge is secured to the upper rail 12. In the closed state the strip portions 6, 7 bear on the lower rail 13.

The example of embodiment illustrated in FIG. 6 is a special form in which the upper rail 12 of the device includes an acute angle with the lower rail 13. In this example of embodiment the strip portion 6 arranged between the centre tension wires 3 is telescopically extendable.

In addition, the bores, eyes or the like through which the centre tensioning wires extend are made in the form of slots in this example of embodiment. In this manner, in the opened position of the hanging means the telescopically formed strip portion can be displaced parallel beneath the upper rail 12 and the change of length made necessary by this displacement in the hanging means compensated via the slotlike configuration of the eyes.

In the example of embodiment illustrated in FIG. 7 instead of the outer tensioning wire a steel spoke 14 is provided which is bent corresponding to the form of the glass area to be shaded. The profile strip in this example of embodiment is divided into a total of seven strip portions 6, 7, the strip portions 7 provided in the region of the inner tensioning wires 3 being formed as short sliding pieces.

In this embodiment as well it is necessary for the strip portions 6 adjoining the centre sliding piece to be made telescopically extendable. It is also necessary for the bores, eyes or the like of the hanging means, which are guided on the centre tensioning wires 3, to be made slotlike.

With partially broken-away right side, FIG. 8 shows the arrangement of two devices according to the invention when used in a gable window. Each of the two devices in the present example of embodiment covers a glass area in the form of a right-angled triangle. In the closed state the profile strips consisting each of two strip portions 6 bear parallel on a vertically extending tensioning wire 15 which extends vertically from an upper corner 16 of the gable downwardly to a horizontally extending window base.

For opening the hanging means or blind means the two strip portions 6 of each device are each moved in the direction of the arrow 18 into the region of the lateral corners 19 of the gable. In this operation the vertical pleated hanging means 5, having folds, is pushed together as shown in FIG. 8. As soon as the two upper strip portions 6 extend parallel to the side edges 20 of the gable window the largest opening cross-section has been reached. In the region of the corners 19 a certain area region of the hanging mean remains which in the present case enhances the gable character as decorative termination.

I claim:

1. A device for shading an area having a geometric shape, said device comprising an extendable-retractable drape having an extended shape corresponding to the shape of said area and a displaceable edge for extending and retracting the drape, the displaceable edge comprising a profile strip and the drape having side edges adjoining the displaceable edge, the side edges being guided by elongate holding means, wherein the profile strip is divided lengthwise into at least two substantially rigid strip portions and interconnecting means between the strip portions for providing articulation of said portions.

2. A device according to claim 1 for an area having a narrower portion and a wider portion wherein the drape has an extended configuration for location of the profile strip in an unfolded condition of the strip portions along the wider portion and a retracted configuration for location of the profile strip in a folded condition of the strip portions within the narrower portion.

3. A device according to claim 1 having an extended shape in the form for an equivalently shaped area, said triangle having abase, an apex, a base portion constituting said wider portion and an apex portion constituting said narrower portion wherein the holding means define sides of the triangle and the profile strip in the unfolded condition defines the base of the triangle.

4. A device according to claim 1, having an extended shape in the form of a polygon for an equivalently shaped area, said polygon having a shorter top edge, a longer bottom edge and side edges connecting the top and bottom edges wherein the holding means define said side edges and the profile strip in the unfolded condition defines said bottom edge.

5. A device according to claim 1 having an extended shape in the form of an enclosed area having one curved edge and one straight edge wherein the holding means define said curved edge and wherein the profiled strip in the unfolded condition defines said straight edge.

6. A device according to claim 1, wherein the strip portions have a U-shaped profile.

7. A device according to claim 1, wherein the strip portions are telescopically extendable.

8. A device according to claim 1, wherein each holding means comprises one of a rope and a cable.

9. A device according to claim 1, wherein each holding means comprises a tensioning wire.

10. A device according to claim 1, wherein each holding means comprises a spoke.

11. A device according to claim 1, wherein each holding means comprises a profiled guide.

12. A device according to claim 1, wherein the interconnecting means includes an elastic intermediate member between respective strip portions.

13. A device according to claim 12, wherein the intermediate member comprises a flexible tape strip.

14. A device according to claim 1, wherein the interconnecting means includes a hinge between respective strip portions.

15. A device according to claim 1, wherein the strip portions include respective outer strip portions having outer ends with guides engaging respective ones of the holding means.

16. A device according to claim 15, wherein each guide comprises a sliding guide.

17. A device according to claim 1, including a pull cord means on said displaceable edge.

18. A device according to claim 1, wherein the drape includes respective pleats which in a retracted condition of the drape are parallel to respective ones of the strip portions.

19. A device according to claim 1, further including at least one intermediate elongate holding means for guiding an intermediate portion of the drape.

20. A device according to claim 19, wherein one of the strip portions is guided on said intermediate holding means.

* * * * *